US005806326A

United States Patent [19]

Watanabe et al.

[11] Patent Number: 5,806,326

[45] **Date of Patent: *Sep. 15, 1998**

[54] REFRIGERATION CYCLE

[75] Inventors: Yukio Watanabe, Kyoto-fu; Hisao Wakabayashi, Shiga; Hironao Numoto, Shiga; Shinji Watanabe, Shiga; Akira Fujitaka, Shiga; Kanji Haneda, Kyoto-fu; Yoshinori Kobayashi, Shiga; Yuichi Yakumaru, Shiga; Narito Yamaguchi, Shiga, all of Japan

[73] Assignee: Matsushita Electric Industrial Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 764,116

[22] Filed: Dec. 9, 1996

[30] Foreign Application Priority Data

Dec. 11, 1995 [JP] Japan ..... 7-321342

[51] Int. Cl.[6] ..... F25B 41/06

[52] U.S. Cl. ..... 62/114; 65/511

[58] Field of Search ..... 62/511, 527, 114; 138/40, 44

[56] References Cited

U.S. PATENT DOCUMENTS

| | | | |
|---|---|---|---|
| 2,666,454 | 1/1954 | Richmond | 138/44 |
| 2,720,756 | 10/1955 | Stebbins | 62/511 |
| 3,531,947 | 10/1970 | Drury et al. | 62/511 |
| 3,894,562 | 7/1975 | Moseley, Jr. et al. | 138/44 |
| 4,150,558 | 4/1979 | Pohl | 138/40 |
| 4,408,467 | 10/1983 | Murname et al. | 62/511 |
| 4,793,150 | 12/1988 | Wattley | 62/511 |

FOREIGN PATENT DOCUMENTS

| | | |
|---|---|---|
| 6-159865 | 6/1994 | Japan . |
| 6-235570 | 8/1994 | Japan . |
| 7-27448 | 1/1995 | Japan . |

*Primary Examiner*—William E. Tapolcai
*Attorney, Agent, or Firm*—McDermott, Will & Emery

[57] ABSTRACT

A refrigeration cycle that controls the deposit of foreign matter at inlet or outlet of a capillary tube, which forms an expansion device in the refrigeration, regardless of changeover from a cooling operation to a heating operation. In particular, in a refrigeration cycle using an alternative refrigerant, a junction is provided for joining an end of a capillary tube forming an expansion device to the piping through which the refrigerant flows. The junction has a slope defined by the inside diameter thereof, which gradually decreases from the side of the junction that joins the piping to the side of the junction that joined the capillary tube. An end portion of the capillary tube projects into the junction at the piping side. The projecting end of the capillary tube is opened obliquely to the axial line of the capillary tube. A hole is formed in the peripheral wall of the projecting end of the capillary tube. According to such an arrangement, foreign matter in the refrigerant is forced to be deposited in portions of the refrigerant cycle other than the capillary tube and prevented from clogging the capillary tube.

8 Claims, 13 Drawing Sheets

REFRIGERATION CYCLE

BACKGROUND OF THE INVENTION

The present invention relates to a refrigeration cycle, and more particularly to a refrigeration cycle connecting a compressor, a condenser, an expansion device, and an evaporator in a loop by piping, using a mixed refrigerant or alternative refrigerant mixing at least one or two or more types of hydrochlorofluorocarbon refrigerants.

The compressor used in the refrigeration cycle, in particular, is the maintenance-free enclosed compressor composed of, as disclosed in Japanese Laid-open Patent 62-298680, a compressive mechanism filling an enclosed container with a mixed refrigerant and oil for compressing by sucking refrigerant, an oil pump for feeding the oil into machine sliding parts, and a motor for driving them by drive shaft.

On the other hand, the refrigeration cycle uses a refrigerant such as chlorofluorocarbons (CFCs) or R12 and designated hydrochlorofluorocarbons (HCFCs) or R22. The specific CFCs are chemically stable, and free from flammability and toxicity as compared with hitherto known refrigerants such as sulfur dioxide and methyl chloride, and are widely applied as ideal refrigerants and have been used for many years.

Recently, however, chlorine atoms contained in the molecules of specific CFCs are recognized to induce destruction of the ozone layer, and development and use of alternative refrigerants not containing chorine atoms have been attempted.

As a practical alternative refrigerant, for example, a chlorine-free refrigerant such as hydrofluorocarbon has been proposed (Hydraulic and Pneumatic Technology, June 1994, Nippon Kogyo Shuppan). As an alternative refrigerant, for example, R134a is used.

Since chlorine is not contained in the refrigerant, however, the alternative refrigerant is not expected to have an excellent lubricity as in the conventional specific CFCs. Accordingly, as the oil to be contained in the enclosed container, an oil compatible with the alternative refrigerant is particularly required. The oil contained in the enclosed container is stirred by the alternative refrigerant discharged from the compressive mechanism into the enclosed container, and is further stirred by rotor of the motor. At this time, if the oil is compatible with the alternative refrigerant, the oil is stirred well with the refrigerant discharged into the enclosed container, and permeates into narrow gaps in the sliding parts of the machines. Therefore, together with the effects of the supply of oil by an oil pump, the lubricating performance is enhanced. As such oil, as disclosed in Japanese Laid-open Patent 6-235570, an ester derivative synthetic oil is used.

However, when an enclosed compressor is operated in such conditions and the refrigeration cycle is executed and continued, foreign matter may be deposited in the inlet and outlet of capillary tubes forming the expansion device, and the flow of the refrigerant is blocked relatively early, and the refrigerating function is lowered.

To elucidate and study the cause of such a defect, various experiments were conducted. As a result, it was found to be due to the use of the ester oil as the oil compatible with the alternative refrigerant. If moisture invades when enclosing the refrigerant piping, or moisture is formed after enclosing due to some reason, the ester oil is hydrolyzed by the moisture, and produces fatty acid. The fatty acid corrodes the parts in the piping, forms metal soap and produces sludge. The ester oil is low in stability, and therefore foreign matter is likely to be dissolved and mixed in when the temperature is raised, or foreign matter is likely to precipitate when the temperature is lowered. At the inlet of the capillary tube, the flow velocity of the refrigerant drops, and hence, the precipitating foreign matter is likely to be adhered to cause clogging. At the outlet of the capillary tube, since the temperature is lowered, foreign matter is likely to precipitate and stick.

The above Japanese Laid-open Patent 6-235570 discloses a refrigeration cycle characterized by solving the problems of faulty flow of refrigerant or clogging in the capillary tube, by capturing the foreign matter by installing a filter immediately at the upstream side in the flow direction of the refrigerant in the capillary tube in the midst of the refrigerant piping.

However, the above filter structure is complicated and expensive, and it cannot cope with the defect of precipitation due to temperature drop at the outlet of the capillary tube and immediate deposit of the precipitates. In the refrigeration cycle operated by the heat pump, if the flow direction of refrigerant is reverse in changeover of heating and cooling, the filter must be provided at both sides of the capillary tube, which further adds to the cost.

It is an object of the invention to present a refrigeration cycle of high reliability capable of suppressing deposit of foreign matter at the outlet or inlet of the capillary tube in a simple and inexpensive structure, regardless of the changeover from a cooling operation to a heating operation, and vice versa.

BRIEF SUMMARY OF THE INVENTION

The refrigeration cycle of the invention comprises a compressor, a condenser, an expansion device, and an evaporator connected in a loop by piping, using an alternative refrigerant, in which the expansion device has a capillary tube and a junction for connecting the capillary tube and piping, wherein the inside diameter of the junction is larger than the inside diameter of the capillary tube. Foreign matter that may impede the passing of a refrigerant is deposited aggressively in an inside space of the connection pipe. In particular, the junction has a slope decreasing gradually in the inside diameter from the piping side to the capillary tube side. This slope forms a wide inside space at the end portion of either inlet or outlet part of the capillary tube, regardless of the direction in which the refrigerant flows. In this arrangement, foreign matter deposited on the inner surface of the connection pipe does not impede the main flow of the refrigerant in the capillary tube or junction because of the wide space in the junction. Therefore, the refrigerating function of the refrigerating cycle is stable for a long period, and its reliability is enhanced. Moreover, the above effects are obtained only by the improvement of the duct shape of each junction joining the capillary tube and piping. Hence, the structure is simple and inexpensive.

Another refrigeration cycle of the invention comprises a compressor, a condenser, an expansion device, and an evaporator connected in a loop by piping, using an alternative refrigerant, in which the expansion device has a capillary tube and a junction for connecting the capillary tube and piping, and the capillary tube projects into the junction. In whichever direction the refrigerant may flow, the end portion at the inlet or outlet of the capillary tube projects into the junction of larger diameter than the end portion, and the flow of refrigerant is stagnant between the outer surface of the protrusion and the wide inner surface of the junction of the piping side, so that much of the foreign matter gets deposited aggressively on the outer surface of the protrusion and inside of the junction and in the space between them. Moreover, the depositing foreign matter in this manner has no negative effect on the main flow of the refrigerant in the capillary tube and junction. Further, clogging of capillary tube can be prevented for a longer period. Therefore, the refrigeration operation of the refrigerating cycle is stable for a long period, and its reliability is enhanced. Moreover, the above effects are obtained only by the improvement of the connection state of each junction joining the capillary tube and piping. Hence, the structure is simple and inexpensive.

In the above arrangement, it is particularly preferred that the junction may have a slope gradually decreasing in inside diameter from the piping side to the capillary tube side. The structure is not complicated, and yet the advantage of having a an expansion device operate without getting clogged is obtained.

In a variation, the projecting end of the capillary tube is particularly preferred to be opened obliquely to the axial line of the capillary tube. By this modification, the opening area of the piping side of the capillary tube to the wide space side is large, and therefore the foreign matter is less likely to be caught in the opening of the projecting end at the inlet and outlet of the capillary tube, so that the prevention of the deposition of foreign matter at the capillary tube inlet and outlet may be further enhanced.

In another variation, it is particularly preferred that a hole is provided in the peripheral wall of the projecting end of the capillary tube. With such a modification, the entering or leaving of the refrigerant between the projecting end of the capillary tube and wide junction at the piping side may be smoothed by the hole. This smooth flow of refrigerant interferes or impedes the deposit of foreign matter on the end portion at the inlet or outlet of the capillary tube. Therefore, by a simple additional formation of a hole, the foreign matter deposit preventive function at the inlet and outlet of the capillary tube may be further enhanced.

In yet another improvement, the capillary tube forming the expansion device comprises plural capillary tubes differing at least in the inside diameter or length. It is particularly preferred that these plural capillary tubes are connected parallel. With this modification, foreign matter clogging occurs in the sequence of difficulty of flow of refrigerant (that is, from the capillary tube having smaller inside diameter or longer capillary tube). Therefore, the early clogging of the entire capillary tubes is prevented, and a normal operation flow or function is maintained for a long period. In this arrangement, only the number of capillary tubes is increased, and in proportion to the increase in the number of capillary tubes, the required diameter of capillary tubes is smaller or shorter in length, so that the structure resulting in an improved flow is not particularly complicated.

In another arrangement, it is particularly preferred that a slope connected in batch with each capillary tube, gradually increasing in the inside diameter from the piping side to each capillary tube side, is formed in the junction joining the plural capillary tubes and piping. With this arrangement, utilizing the space wider than the piping by the slope, plural capillary tubes can be connected in a batch. By a simple structure of increasing only the junction, the effects of the deposit of foreign matter on the flow of refrigerant, and occurrence of clogging, may be notably prevented by the wide space.

Preferably, each capillary tube should be projected into the slope. With such an arrangement, the intrinsic actions and effects as mentioned above can be exhibited.

The projecting ends of the capillary tubes are particularly preferred to be opened obliquely to their axial line. In this manner, the intrinsic actions and effects as mentioned above can be exhibited.

Preferably, a hole should be provided in the peripheral wall of the projecting end of capillary tube. In this way, the intrinsic actions and effects as mentioned above can be exhibited.

In an arrangement, preferably, the capillary tube forming the expansion device comprises plural capillary tubes, and each one of the plural capillary tubes has an valve. The capillary tubes in use can be assembled into one by opening or closing the valves, and the capillary tubes in use can be sequentially changed over, depending on the degree of clogging of the capillary tubes with foreign matter. With such an arrangement, early clogging of the entire capillary tubes is prevented. The changeover control is effected by the method of utilizing the control means for controlling the operation of the refrigeration cycle itself, and a normal function can be maintained for a long period without particularly complicating the structure.

A different refrigeration cycle of the invention comprises a compressor, a condenser, an expansion device, and an evaporator connected in a loop by piping, using an alternative refrigerant, and further comprises a heat pump changeover valve. The expansion device comprises plural capillary tubes, and a junction for connecting the capillary tubes and a piping, and the plural capillary tubes have individually a one-way valve, and are connected so that the direction of the one-way valves may be opposite to each other. In such an arrangement, during the changeover between the cooling operation and heating operation, if the flow direction of refrigerant is inverted, by limitation of flow direction by one-way valve, the passing capillary tubes of the refrigerant in cooling operation and heating operation can be used selectively. Therefore, clogging of capillary tubes due to foreign matter can be reduced to half.

In the above constitution, the expansion device possesses plural capillary tubes, and the plural tubes are connected in series through the connection pipes provided among them. The connection pipes have a larger inside diameter than the inside diameter of the capillary tubes. Since the inside diameter of the connection pipes is wider, the refrigerant is caused to flow stagnantly, and foreign matter can be deposited by force to be removed from the refrigerant, so that adhesion to the capillary tubes can be prevented.

The capillary tubes can be divided by the connection pipes so that the foreign matter may not affect the flow of the refrigerant, and the actual length of capillary tubes is shortened to several times smaller than the required length, so that foreign matter may hardly be deposited on the capillary tubes.

In the constitution, preferably, the inner surface of the capillary tubes should have a smooth layer. By the smoothness of the smooth layer in the inner surface of the capillary tube, foreign matter is less likely to be caught or adhered.

In the constitution, preferably, the inner surface of the capillary tubes for composing the expansion device should have a parting process surface treated for parting. Therefore, foreign matter is less likely to deposit on the parting surface of the inner surface of the capillary tube.

In the constitution, preferably, the inner surface of the capillary tubes for composing the expansion device should have a hydrophilic layer treated for hydrophilic property. Therefore, deposit of oily foreign matter can be prevented by hydrophilic property of the inner surface of the capillary tubes.

In the constitution, preferably, the inside diameter of the junction of the capillary tubes for composing the expansion device and the piping should be larger than the inside diameter of the capillary tubes. Moreover, the inner surface of the junction should have a rough surface processed by roughening. By sticking foreign matter aggressively to the inner surface of a wide rough surface of the junction, the foreign matter in the refrigerant can be removed, and at the same time, effects of the foreign deposit on the flow of refrigerant can be eliminated. Hence, foreign matter is less likely to deposit on the inner surface of the inlet and outlet of the capillary tubes.

In the constitution, preferably, the inside diameter of the junction of the capillary tubes for composing the expansion device and the piping should be larger than the inside diameter of the capillary tubes, and moreover the inner surface of the junction should have an oleophilic surface processed by oleophilic treatment. By sticking oily foreign matter aggressively to the inner surface of a wide oleophilic surface of the junction, the foreign matter in the refrigerant can be removed, and at the same time, effects of the foreign deposit on the flow of refrigerant can be eliminated. Hence, foreign matter is less likely to deposit on the inner surface of the inlet and outlet of the capillary tubes.

The invention itself, together with further objects and attendant advantages, will best be understood by reference to the following detailed description taken in conjunction with the accompanying figures.

DETAILED DESCRIPTION Of THE INVENTION

Preferred embodiments of the present invention are described below while referring to FIG. 1 to FIG. 17.

(Embodiment 1)

Figure 1:
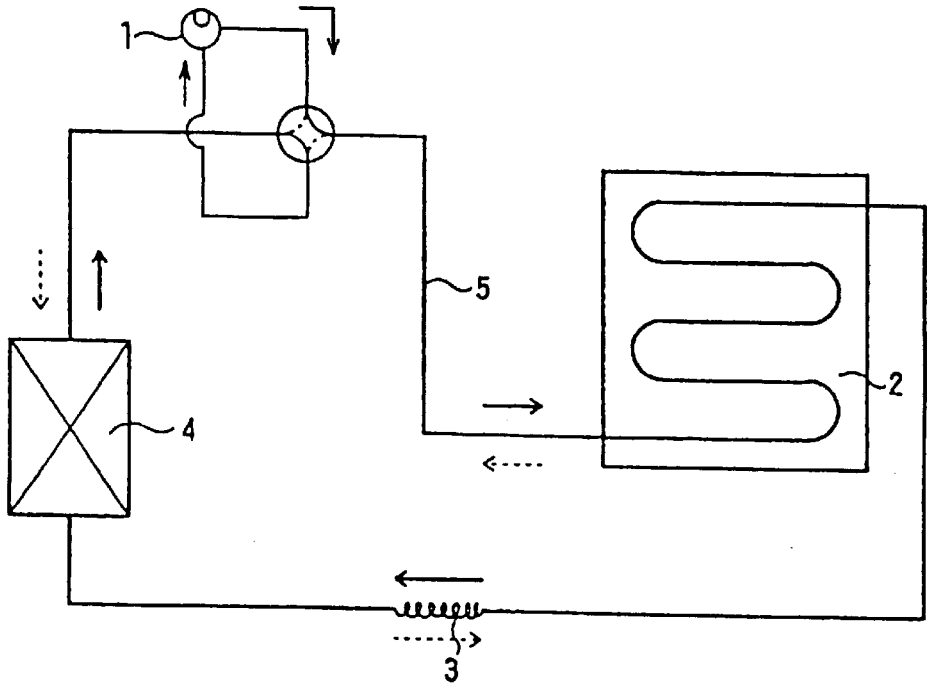
FIG. 1 is a schematic diagram of refrigeration cycle of heat pump type in a first embodiment of the invention.

FIG. 1 illustrates a first embodiment of a schematic diagram of a refrigeration cycle of a heat pump type. The refrigeration cycle depicted in FIG. 1 comprises a compressor 1, a condenser 2, an expansion device 3, and an evaporator 4 connected in a loop by means of a piping 5, using an alternative refrigerant. In using a synthetic oil compatible with the alternative refrigerant, foreign matter mixed in the refrigerant may adhere to the inlet or outlet of the capillary tubes of the expansion device, regardless whether the refrigeration cycle is operated by changing over between a cooling operation and a heating operation. There is a four-way valve (not shown) for changing over between cooling operation and heating operation located in the piping 5. In the cooling operation, the refrigerant flows in the direction indicated by arrow into the condenser 2, expansion device 3 and evaporator 4, as shown in FIG. 1. In heating operation or heat pump operation, the refrigerant flows in a reverse direction. Hence, in the cooling operation, the condenser 2 functions as an evaporator, and the evaporator 4 functions as a condenser.

Figure 2:
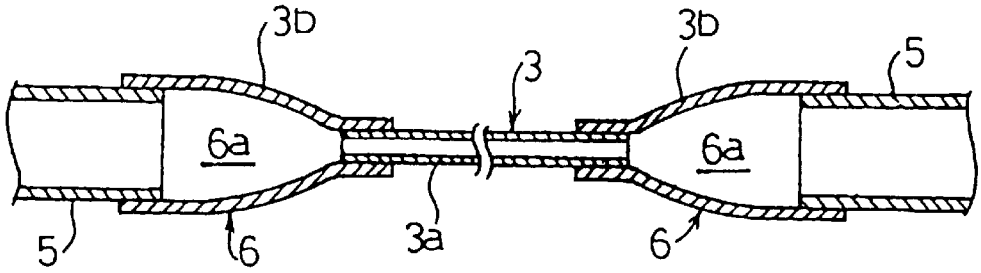
FIG. 2 is a sectional view showing a connection structure of piping and expansion device in FIG. 1.

As an example, suppose the synthetic oil compatible with the alternative refrigerant used in such a refrigeration cycle, is for example, an ester oil. In a cooling operation or a heating operation, foreign matter mixing in or precipitating in the refrigerant is likely to deposit inner surface of the end portions of the inlet and outlet of the capillary tubes 3*a* of the expansion device 3 (FIG. 2). Such a deposit of foreign matter will block the flow of the refrigerant due to clogging occurs, and thereby the refrigeration cycle will malfunction.

The details of the piping 5 and expansion device 3 according to the first embodiment is shown in FIG. 2. As shown in FIG. 2, there are provided, connecting portions or junctions 3*b* joining the ends of the capillary tube 3*a*, forming the expansion device 3, and the piping 5, each in the form of a slope 6 decreasing gradually in inside diameter from the piping 5 side to the capillary tube 3*a* side. This slope 6 forms a wide space 6*a* at both ends at the inlet and outlet of the capillary tube 3*a*, regardless of the direction of flow of the refrigerant. As a result, if foreign matter is deposited on the inner surface of the junction 3*b* in the space 6*a*, the deposited foreign matter does not affect or clog the main flow of the refrigerant in the capillary tube 3*a* and junction 3*b* because the space of the junction 3*b* is wide. Moreover, closing of the capillary tube 3*a* is prevented. As a result, the refrigeration function of the refrigeration cycle remains stable for a long period, and a high reliability is obtained. Moreover, by only improving the duct shape of each junction 3*b* of the capillary tube 3*a* and piping 5, the above effects are obtained at a low cost.

In the first embodiment, the junction 3*b* is preferably formed separately; not integrally with the piping 5 and capillary tube 3*a*. Therefore, the piping 5, capillary tube 3*a* and junction 3*b* are mutually linked together, and the slope shape of the junction 3*b* can be easily formed by being processed as an independent part. Also in the first embodiment, this independent junction 3*b* is fitted externally to the end of the piping 5 and capillary tube 3*a*. This improved structure joining the end of the piping 5 and capillary tube 3*a* in itself serves to expand the space of the junction 3*b* by means of the slope 6. As a result, the effect of any deposited foreign matter on the flow of the refrigerant is reduced, which is advantageous for the long-term stability of the performance of the refrigeration cycle.

As a variation, the junction 3*b* can be also formed integrally with one or both of the piping 5 and capillary tube 3*a*.

As for materials, the junction 3*b*, together with the piping 5 and capillary tube 3*a*, is made of copper as usual, and joined by brazing. However, as a variation, other material and joining process may be also possible.

(Embodiment 2)

A second embodiment joining the piping and expansion device is shown in FIG. 3A. The second embodiment is based on the structure of the first embodiment. Hence, the same members are identified with same reference numerals, and duplicate explanations are omitted.

Figure 3:
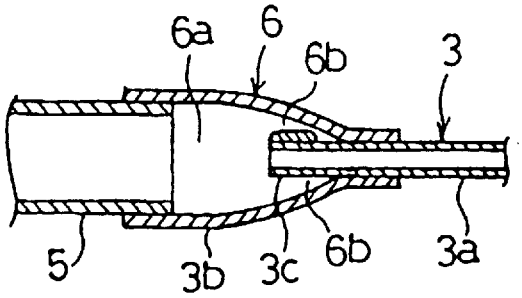
FIG. 3 is a sectional view showing a connection structure of piping and expansion device in a second embodiment of the invention.

In FIG. 3, the capillary tube 3*a* forming the expansion device 3 projects to the inside of the junction 3*b* toward the piping 5 side. In whichever direction the refrigerant flows, the end portion at the inlet or outlet of the capillary tube 3*a* projects inside of the junction 3*b* into the wide space 6*a* that is larger in diameter than the end portion of the junction 3*b*. In this arrangement, the flow of the refrigerant is stagnant in the portion 6*b* between the outer side of the projecting end portion 3*c* and the inner side of the wide junction 3*b*. Therefore, in the portion 6*b*, between the outer side of the projecting end portion 3*c* and the inner side of the junction 3*b*, foreign matter is deposited. This depositing of foreign matter does not affect the main flow of the refrigerant in the capillary tube 3*a* and junction 3*b*. In the second embodiment, the closing of the capillary tube 3*a* is prevented for a longer period, and hence, the performance of the refrigeration cycle is stable for a longer period than in the first embodiment, and the reliability is notably enhanced. Moreover, by only inserting an end of the capillary tube 3*a* into the junction 3, the above effects are obtained and at a low cost.

Ii should be understood that the connection structure according to the second embodiment is not limited to the constitution or arrangement shown in FIG. 3. For example, the small diameter-end portion of the capillary tube 3*a* may project from the end plate closing the end portion of the piping 5 of larger diameter to the inner side of the piping 5. In this constitution, the intrinsic actions and effects of the embodiment are exhibited, and the function of the refrigeration cycle can be stabilized for a long period to a certain extent.

(Embodiment 3)

Figure 4:
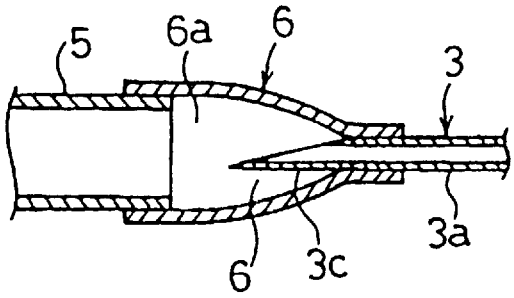
FIG. 4 is a sectional view showing a connection structure of piping and expansion device in a third embodiment of the invention.

A third embodiment is based on the first and second embodiments, and is shown in FIG. 4. The same members are identified with same reference numerals. The characteristic points of the third embodiment are described below.

In FIG. 4, a projecting end 3*c* of the capillary tube 3*a* is opened obliquely to the axial line of the capillary tube 3*a*, and the obliquely opened projecting end 3*c* projects to the inside of the junction 3*b*.

In this arrangement, the opening area of the capillary tube 3*a* to the wide space 6*a* side of the piping 5 side is wider, so that foreign matter is hardly caught in the opening of the projecting end 3*c* at the inlet or outlet of the capillary tube 3*a*. As a result, without complicating the structure, the preventive effect of deposited foreign matter at the inlet or outlet of the capillary tube 3*a* is further enhanced. However, it should be understood that the third embodiment is not limited to the arrangement of the first embodiment.

(Embodiment 4)

Figure 5:
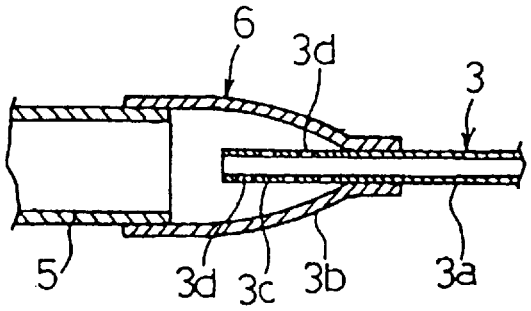
FIG. 5 is a sectional view showing a connection structure of piping and expansion device in a fourth embodiment of the invention.

A fourth embodiment is based on the first and second embodiments, and is depicted in FIG. 5. The same members are identified with same reference numerals. The characteristic points of the embodiment are described below.

In FIG. 5, holes 3*d* are formed in the peripheral wall of the projecting end 3*c* of the capillary tube 3*a*.

In this arrangement, the entering or leaving of a refrigerant, between the capillary tube 3*a* and wide junction 3*b* at the piping 5 side, is smoothed by the holes 3*d*. This smooth flow of refrigerant interferes with the deposit of foreign matter on the projecting end 3*c* at the inlet or outlet of the capillary tube 3*a*. This prevents the deposit of foreign matter at the inlet or outlet of the capillary tube 3*a*, further enhancing the efficient flow of the refrigerant. Of course, it should be understood that the fourth embodiment is not limited to the arrangement of the first embodiment.

(Embodiment 5)

Figure 6:
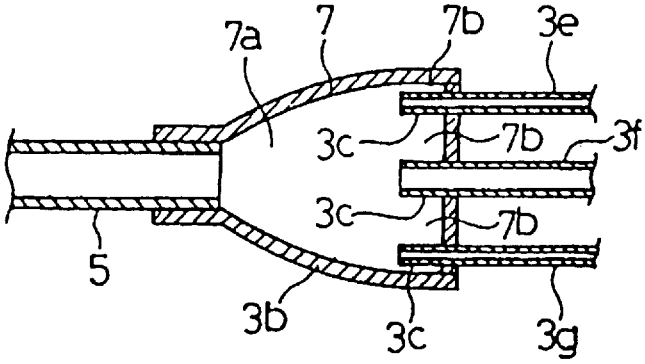
FIG. 6 is a sectional view showing a connection structure of piping and expansion device in a fifth embodiment of the invention.

A fifth embodiment is shown in FIG. 6 and is based on the refrigeration cycle of the first to fourth embodiments.

In FIG. 6, the capillary tube 3, forming the expansion device 3, includes a plurality of capillary tubes differing in inside diameter. For example, three capillary tubes 3*e*, 3*f*, 3*g* project to the inside of the junction 3*b* and are connected. According to the fifth embodiment, the capillary tubes are clogged sequentially from the tube 3*g* having the smallest inside diameter. As a result, the early clogging of the entire set of capillary tubes 3*e* to 3*g* is prevented, and the normal operation of the refrigeration cycle is maintained for a longer period.

As a variation, the number of capillary tubes 3*e*, 3*f*, 3*g* can be increased, and in proportion to the increase in the number of capillary tubes 3*e*, 3*f*, 3*g*, the required tube diameter of the capillary tubes 3*e*, 3*f*, 3*g* can be reduced. Hence, the flow of refrigerant through the expansion device can be improved with structure that is not particularly complicated.

In particular, the junction 3*b* joining the plurality of capillary tubes 3*e*, 3*f*, 3*g* and the piping 5 has a slope 7 gradually increasing in the inside diameter from the piping 5 side to the side of the capillary tubes 3*e*, 3*f*, 3*g*. The junction 3*b* has a wider space 7*a* than the piping 5 owing to this slope 7. By making use of this wide space 7*a*, the plural capillary tubes 3*e* to 3*g* can be connected in batch. Moreover, by this wide space 7*a*, the effects of deposited foreign matter on the refrigerant and occurrence of clogging can be further prevented.

As a further variation, by projecting the capillary tubes 3*e*, 3*f*, 3*g* into the slope 7, the outer surface of each projecting end 3*c* of the capillary tubes 3*e* to 3*g*, the inner surface of the slope 7, and the portion 7*b* can exhibit the same actions and advantages as in the second embodiment.

Not limited to this, the fifth embodiment may be improved further by combining with the characteristic structure of at least one of the third and fourth embodiments to obtain the intrinsic actions and advantages of these embodiments, as previously described.

(Embodiment 6)

Figure 7:
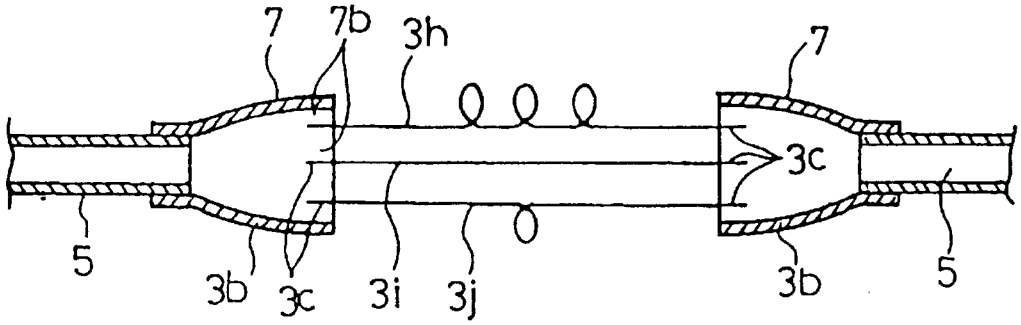
FIG. 7 is a sectional view showing a connection structure of piping and expansion device in a sixth embodiment of the invention.

A sixth embodiment is shown in FIG. 7. In FIG. 7, instead of the plural capillary tubes differing in diameter, as in the fifth embodiment, plural capillary tubes 3*h*, 3*i*, 3*j*, differing in length are connected in parallel. In this constitution, the capillary tubes are clogged sequentially from the one largest in length 3*h*, and the early clogging of the entire set of capillary tubes 3*h*, 3*i*, 3*j* is prevented, so that the normal operation of the refrigeration cycle can be maintained for a longer period.

As a variation, the number of capillary tubes 3*h* to 3*j* can be increased, and in proportion to the increase in the number of capillary tubes 3*h*, 3*i*, 3*j*, the required tube diameter of the capillary tubes 3*h* to 3*j* can be reduced. Hence, the flow of the refrigerant through the expansion device can be improved without the need for a particularly complicated structure.

It should be understood that an embodiment combining the constitutions of both the fifth embodiment and the sixth embodiment is possible. Under such an arrangement, it is easier to classify the difficulty of the flow of refrigerants. As a result, the difficulty of flow of refrigerant can be further increased by forming the longest capillary tube with the smaller diameter; whereas the ease of flow of refrigerant can be further increased by forming the shortest capillary tube with the largest diameter.

(Embodiment 7)

Figure 8A:
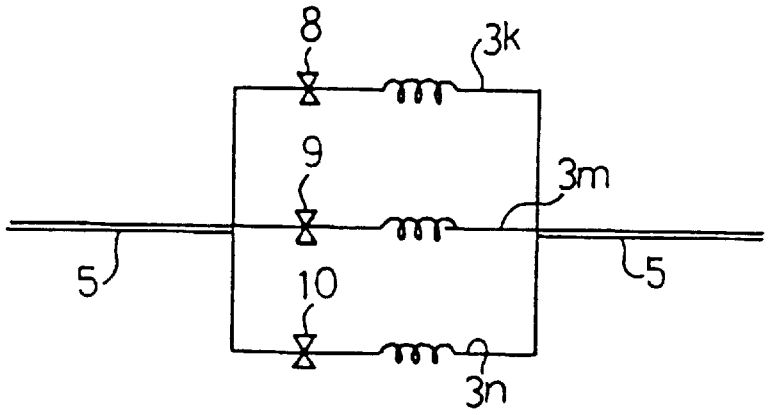
FIGS. 8(*a*) and 8(*b*) are a schematic depiction showing a connection structure of piping and expansion devices in a seventh embodiment of the invention, and a block diagram of control means, respectively.
Figure 8B:
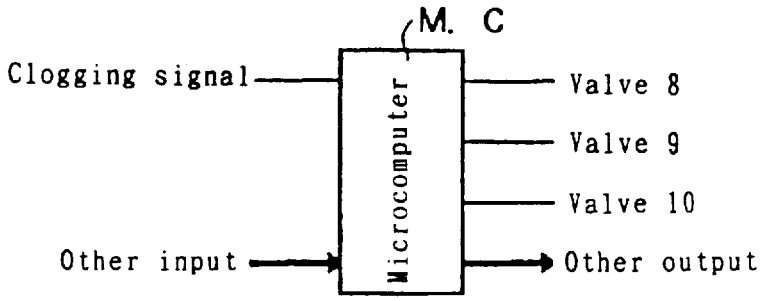

A seventh embodiment is shown in FIGS. 8(*a*) and 8(*b*). The seventh embodiment replaces the fifth and sixth embodiments.

As shown in FIG. 8(*a*), an expansion device 3 is depicted having a plurality of capillary tubes 3*k*, 3*m*, 3*n*, each respectively including valves 8 to 10, with the tubes being connected to the piping 5. By opening or closing of the valves 8 to 10, the three capillary tubes 3*k*, 3*m*, 3*n* can be opened or closed sequentially. This arrangement prevents the early clogging of all the capillary tubes 3*k*, 3*m*, 3*n*.

The opening and closing of the valve 8–10 is controlled by a control means use for in operation control of the refrigeration cycle itself. For example, a microcomputer MC, as shown in FIG. 8 (*b*), can be used to control the valves in response to various input signals such as a clogging signal sensed by structure not shown. In this manner, the normal operation of the refrigeration cycle can be maintained for a long period without particularly complicated structure.

In particular, every time a clogging signal is received either automatically or manually, the microcomputer MC sequentially changes over the valves 8 to 10, thereby changing over the capillary tubes 3*k*, 3*m*, 3*n* in use. For such an automatic changeover, the microcomputer MC can obtain, for example, a clogging signal automatically by judging the passing resistance of refrigerant in the capillary tubes 3*k*, 3*m*, 3*n* in use. The judging could be part of an internal function used for detecting an abnormal pressure rise of refrigerant or the like.

(Embodiment 8)

Figure 9:
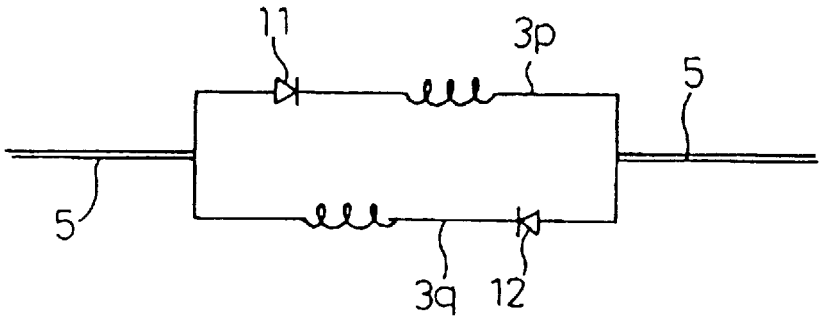
FIG. 9 is a sectional view showing a connection structure of piping and expansion device in an eighth embodiment of the invention.

An eighth embodiment is shown in FIG. 9. The eighth embodiment can replace the fifth to seventh embodiments, and belongs to the refrigeration cycle having a heat pump changeover valve, same as in the first embodiment. As shown in FIG. 9, the expansion device 3 possesses capillary tubes 3*p*, 3*q* provided with one-way valves 11, 12 respectively. These two capillary tubes 3*p*, 3*q* are connected parallel so that the direction of the mutual one-way valves 11, 12 may be opposite to each other. During a cooling operation and a heating operation, the flow direction of refrigerant is mutually opposite. Corresponding to this, by the flow direction control by the one-way valves 11, 12, the capillary tube passing the refrigerant is changed over during the cooling operation and the heating operation. Therefore, clogging of the capillary tubes 3*p*, 3*q* due to deposit of foreign matter can be reduced in half. As a result, the reliability of the refrigeration cycle is enhanced, and the cost is lowered without complicating the structure.

According to the eighth arrangement, it is also possible to design the capillary tube having the one-way valve 11 and the capillary tube having the one-way valve 12 with different diameters or lengths, so that the plurality of capillary tubes may be clogged sequentially.

(Embodiment 9)

Figure 10:
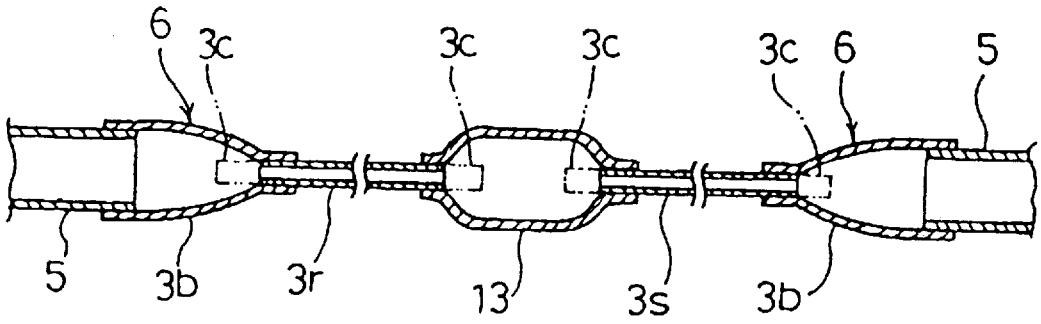
FIG. 10 is a sectional view showing a connection structure of piping and expansion device in a ninth embodiment of the invention.

A ninth embodiment is shown in FIG. 10. This embodiment is based on the refrigeration cycle described in the first embodiment.

As shown in FIG. 10, the ninth embodiment includes a plurality of capillary tubes forming an expansion device 3. For example, two capillary tubes 3*r*, 3*s* are connected in series, with a connection pipe 13 provided between them. The inside diameter of the connection pipe 13 is larger than the inside diameter of the capillary tubes 3*r*, 3*s*. In this arrangement, the refrigerant is caused to stay stagnant in the connection pipe 13 having the larger inside diameter so that foreign matter may be deposited therein by force. As a result, the foreign matter is removed from the refrigerant, and the depositing of foreign matter on the capillary tubes can be prevented.

Moreover, in an arrangement using a connection pipe 13 for preventing effects of foreign matter on the flow of refrigerant, the capillary tubes can be divided, and the actual length of the capillary tubes may be shortened to be several times smaller than the required length. As a result, the deposit of foreign matter on the capillary tubes can be further prevented. The reliability of the refrigeration cycle is enhanced. At the same time, the performance of the of the refrigeration cycle is enhanced in an inexpensive manner, without using particularly complicated structure.

As a variation, the ninth embodiment may be also combined with the second to eighth embodiments, and the individual intrinsic actions and effects, described with respect to these embodiments, can be exhibited by the varying the ninth embodiment.

(Embodiment 10)

Figure 11:
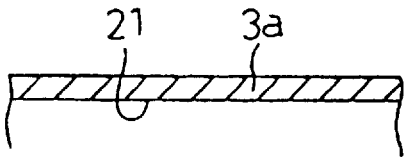
FIG. 11 is a sectional view showing part of capillary tubes for composing an expansion device in a tenth embodiment of the invention.

FIG. 11 is a sectional view of a part of a capillary tube forming the expansion device. The tenth embodiment pertains to the inner surface of the capillary tube. The tenth embodiment is based on the refrigeration cycle of the first embodiment.

As shown in FIG. 11, the inside of the capillary tube 3*a* forming the expansion device 3 has a smoothed surface 21. By providing a smoothed surface 21 on the inside of the capillary tube 3*a*, foreign matter is hardly caught or adhered to the inside of the tube. Therefore, the reliability of the refrigeration cycle is enhanced. Moreover, the performance is enhanced without great expense and without particularly complicating the structure.

The surface of a capillary tube may be smoothed by blast processing, or some other polishing process, or plating, or any other known method for smoothing surfaces.

(Embodiment 11)

Figure 12:
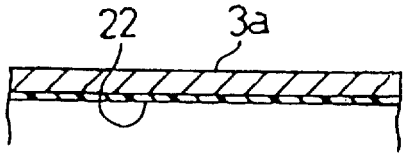
FIG. 12 is a sectional view showing part of capillary tubes for composing an expansion device in an eleventh embodiment of the invention.

FIG. 12 is a sectional view of a part of a capillary tube forming an expansion device. The eleventh embodiment pertains to the inner surface of the capillary tube. The eleventh embodiment is based on the refrigeration cycle of the first embodiment.

As shown in FIG. 12, the inside of the capillary tube 3*a* forming the expansion device 3 has a releasing treated layer 22. By providing the lubricating or releasing property of the releasing treated layer 22 on the inside of the tube, foreign matter is hardly attached or adhered to the inside of the capillary tube 3*a*. Therefore, the reliability of the refrigeration cycle is enhanced. Moreover, the performance is enhanced without great expense and without particularly complicating the structure.

The parting process may be done by, for example, a fluorine coating process, or any other known method.

(Embodiment 12)

Figure 13:
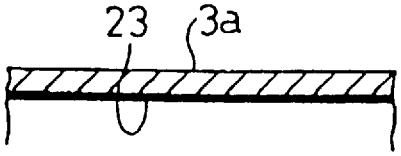
FIG. 13 is a sectional view showing part of capillary tubes for composing an expansion device in a twelfth embodiment of the invention.

FIG. 13 is a sectional view of a part of a capillary tube forming an expansion device. The twelfth eleventh embodiment pertains to the inner surface of the capillary tube. The twelfth embodiment is based on the refrigeration cycle of the first embodiment.

As shown in FIG. 13, the inside of the capillary tube 3*a* forming the expansion device 3 has a hydrophilic treated layer 23. By providing the hydrophilic property of the hydrophilic treated layer 23 to the inner surface of the tube, oily foreign matter is hardly adhered to the inside of the capillary tube 3*a*. Therefore, the reliability of the refrigeration cycle is enhanced. Moreover, the performance is enhanced without great expense and without particularly complicating the structure.

The hydrophilic treated layer 23 is preferably a composition containing, for example, many nitrogen or sulfur atoms. A nitride treated layer is particularly preferred. The layer may be also formed by any other known method.

(Embodiment 13)

Figure 14:
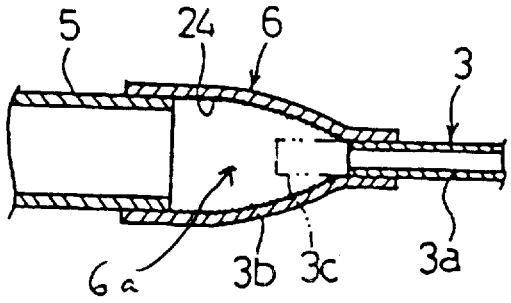
FIG. 14 is a sectional view showing a connection structure of piping and expansion device in a thirteenth embodiment of the invention.

A thirteenth embodiment is shown in FIG. 14. The embodiment is based on the arrangement of the first embodiment.

As shown in FIG. 14, the inside diameter of the junction 3*b* and the piping 5 is set larger than the inside diameter of the capillary tube 3*a*, and a wide space 6*a* is provided. Moreover, the inside of the junction 3*b* has a roughened surface 24. According to this arrangement, foreign matter is forced to be deposited on the roughened surface 24 and the inside of the slope 6 having the wide space 6*a*. In this manner, foreign matter in the refrigerant can be removed. At the same time, the depositing foreign matter prevents negative effects on the flow of the refrigerant. As a result, foreign matter is hardly deposited on the inner surface of the inlet and outlet of the capillary tube 3*a*. The reliability of the refrigeration cycle is enhanced. Moreover, the performance is enhanced without great expense and without particularly complicating the structure.

The surface 24 may be roughened by using a process such as chemical etching or a blast process. The process is not limited to these. Any other known method may be employed.

As a variation, the thirteenth embodiment may be also combined with the second to sixth embodiments or twelfth embodiment.

(Embodiment 14)

Figure 15:
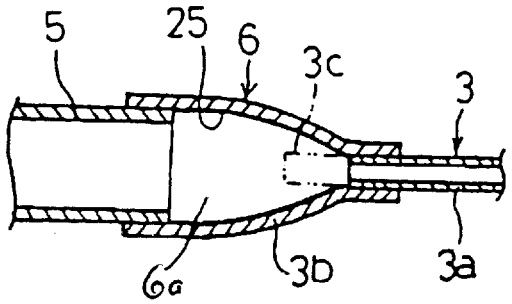
FIG. 15 is a sectional view showing a connection structure of piping and expansion device in a fourteenth embodiment of the invention.

A fourteenth embodiment is shown in FIG. 15. This embodiment is a replacement for the thirteenth embodiment.

As shown in FIG. 15, the inside of the junction 3*b* has an oleophilic treated layer 25. Oily foreign matter is forced to be deposited on the oleophilic inner surface. With the inside of the slope 6 having a wide space 6*a*, foreign matter can hardly be deposited on the inside of the capillary tube 3*a* and other parts of the refrigeration cycle. Therefore, the reliability of the refrigeration cycle is enhanced. Moreover, the performance is enhanced without great expense and without particularly complicating the structure.

The oleophilic treatment of the surface can be carried out by film coating with alcoholic resin or the like.

As described herein, in whichever direction the refrigerant may flow during the cooling operation or the heating operation, the depositing of foreign matter at the end portion, at the inlet or outlet, of the capillary tube is prevented, and hence, the blocking of the flow of refrigerant and the closing of the capillary tube can be prevented. As a result, the refrigeration function of the refrigeration cycle can be stabilized for a long period, and the reliability is enhanced. Moreover, since the structure is not particularly complicated, it is also inexpensive.

Of course, it should be understood that a wide range of changes and modifications can be made to the preferred embodiment described above and that the foregoing description be regarded as illustrative rather than limiting. It is therefore intended that it is the following claims, including all equivalents, which are intended to define the scope of this invention.

What is claimed is:

1. A method for suppressing the deposit of foreign matter in a refrigeration cycle, said refrigeration cycle comprising:

a compressor;

a condenser;

an expansion device having a capillary tube;

an evaporator;

piping connecting said compressor, said condenser, said expansion device, and said evaporator in a loop; and connecting means for connecting opposite ends of said capillary tube to the piping, wherein the connecting means has a slope that decreases gradually in inside diameter from a piping end to an end of the capillary tube, and wherein an end portion of said capillary tube protects inside of said connecting means no further than a portion of the connecting means where the inside diameter is the smallest;

wherein said method comprises the steps of:

circulating a refrigerant that does not contain chlorine atoms in its chemical formula and an oil that has a lubricating performance and is compatible with said refrigerant through said compressor, said condenser, said expansion device, said evaporator, and said piping; and depositing foreign matter mixing in or precipitating in the refrigerant on an inner surface of said connecting means, whereby a deposition of said foreign matter in said capillary tube may be prevented.

2. The method as claimed in claim 1, wherein said refrigerant is a hydrofluorocarbon.

3. The method as claimed in claim 1, wherein said oil includes an ester derivative synthetic oil.

4. The method as claimed in claim 1, wherein said foreign matter is at least one of:

(a) a fatty acid formed by a reaction of said oil, (b) a metal soap formed by a reaction of said oil, and (c) a foreign matter dissolved in said oil.

5. A method for suppressing the deposit of foreign matter in a refrigeration cycle comprising the steps of:

providing a compressor;

providing a condenser;

providing an expansion device having a capillary tube;

providing an evaporator;

connecting said compressor, said condenser, said expansion device, and said evaporator in a loop with piping;

connecting opposite ends of said capillary tube to the piping with a connecting means having a slope that decreases gradually in inside diameter from a piping end to an end of the capillary tube, and inserting an end portion of said capillary tube inside of said connecting means no further than to a portion of the connecting means where the inside diameter is the smallest;

circulating a refrigerant that does not contain chlorine atoms in its chemical formula and an oil that has a lubricating performance and is compatible with said refrigerant through said compressor, said condenser, said expansion device, said evaporator, and said piping; and depositing foreign matter mixing in or precipitating in the refrigerant on an inner surface of said connecting means, whereby a deposition of said foreign matter in said capillary tube may be prevented.

6. The method as claimed in claim 5, wherein said refrigerant is a hydrofluorocarbon.

7. The method as claimed in claim 5, wherein said oil includes an ester derivative synthetic oil.

8. The method as claimed in claim 5, wherein said foreign matter is at least one of:

(a) a fatty acid formed by a reaction of said oil, (b) a metal soap formed by a reaction of said oil, and (c) a foreign matter dissolved in said oil.

* * * * *